United States Patent [19]

Tsuji et al.

[11] Patent Number: 4,646,778

[45] Date of Patent: Mar. 3, 1987

[54] VALVE CONTROL STRUCTURE FOR WORKING VEHICLE

[75] Inventors: Kazuhiko Tsuji, Izumi; Youji Tsutsui, Sakai, both of Japan

[73] Assignee: Kubota, Ltd., Japan

[21] Appl. No.: 719,828

[22] Filed: Apr. 4, 1985

[30] Foreign Application Priority Data

Apr. 5, 1984 [JP] Japan ..... 59-68045

[51] Int. Cl.[4] ..... F15B 13/08

[52] U.S. Cl. ..... 137/270; 74/471 R; 74/471 XY; 137/635; 137/636.2

[58] Field of Search ..... 137/270, 635, 636.2; 74/471 R, 471 XY

[56] References Cited

U.S. PATENT DOCUMENTS 4,098,286 7/1978 Prime ..... 137/636.2 X
4,398,861 8/1983 Shimoie .
4,541,161 9/1985 Shimoie .

*Primary Examiner*—Gerald A. Michalsky
*Attorney, Agent, or Firm*—Kane, Dalsimer, Kane, Sullivan and Kurucz

[57] ABSTRACT

There is disposed a valve control structure for a working vehicle for operating two control valves by means of a control lever rockable crosswise, wherein one of the valves is operable by a rocking movement in a first direction of the control lever and the other valve is operable by a rocking movement in a second direction of the control lever. A connection switching mechanism is provided between the control lever and the valves to switch interlocking relations of the two control valves with respect to the rocking directions of control lever. This switching is readily carried out by operating a single switch lever permits the operator to use the vehicle after selecting the interlocking relations to which he is accustomed.

5 Claims, 7 Drawing Figures

VALVE CONTROL STRUCTURE FOR WORKING VEHICLE

BACKGROUND OF THE INVENTION

This invention relates to a valve control structure for a working vehicle, and more particularly to a valve control structure in which one of two control valves is operable by a rocking movement in a first direction of a crosswise rockable control lever and the other control valve is operable by a rocking movement in a second direction of the control lever.

A known example of the above construction is found with a backhoe wherein a control valve for actuating a swivel deck and a control valve for vertically oscillating a bucket-carrying arm are operated by a single lever rockable crosswise. For this construction one of the following two operational modes is employed, i.e. a mode in which the swivel deck control valve is operated by a rocking movement of the control lever in a fore-and-aft direction of the swivel deck and the arm control valve is operated by a rocking movement of the control lever in a transverse direction of the swivel deck, or a mode in which, conversely to the above, the swivel deck control valve is operated by a rocking movement of the control lever in the transverse direction of the swivel deck and the arm control valve is operated by a rocking movement of the control lever in the fore-and-aft direction of the swivel deck.

Therefore, when a working vehicle is borrowed or is provided new, the vehicle may have an operational mode different from the mode to which the operator is accustomed. In such a situation the operator is prone to a danger of operational error such as actuating the arm when the swivel deck should be actuated.

Furthermore, with certain types of backhoe implement, a bucket-carrying arm is adapted to move at an accelerated speed and the acceleration is effected by switching of hydraulic lines extending between control valves and actuators. However, such a construction has the inconvenience that the hydraulic line switching causes an actuator which has been accelerable to become no longer accelerable and the other actuator to become accelerable.

SUMMARY OF THE INVENTION

Having regard to the state of the art as noted above, the object of this invention is to provide a valve control structure accommodating the two operational modes which are converse with respect to the rocking directions of a crosswise rockable control lever for operating two valves, switching between the two operational modes being readily effected.

In order to achieve this object, a valve control structure according to this invention comprises a control lever rockable crosswise, a first input means connected to the control lever to be operable by a rocking movement in a first direction of the control lever, a second input means connected to the control lever to be operable by a rocking movement in a second direction of the control lever, output means connected to a plurality of valves, and connection switching means disposed between the first and second input means and the output means for switching between a first position wherein the first input means is operatively connected to one of the valves and the second input means is operatively connected to the other valve and a second position wherein the first input means is operatively connected to the other valve and the second input means is operatively connected to said one of the valves.

More particularly, when the connection switching means is operated to produce the first position, the first input means is operatively connected to a first valve and the second input means is operatively connected to a second valve. As a result, the first valve becomes operable by a rocking movement of the control lever in a fore-and-aft direction of a swivel deck and the second valve becomes operable by a rocking movement of the control lever in a transverse direction of the swivel deck. When the connection switching means is operated to produce the second position, the first input means is operatively connected to the second valve and the second input means is operatively connected to the first valve. As a result, the first valve becomes operable by a rocking movement of the control lever in the transverse direction and the second valve becomes operable by a rocking movement of the control lever in the fore-and-aft direction.

Thus, the valve control structure of this invention permits the valves to be operated by two modes, and permits the operator to use a working vehicle safely after selecting the operational mode to which he is accustomed.

There occurs an inconvenience in accelerating the arm of a backhoe implement by switching hydraulic lines between control valves and actuators as noted hereinbefore. The valve control structure of this invention is free from this inconvenience since the switching is effected between the control lever and the control valves.

In one preferred embodiment of this invention the connection switching means comprises a single switch lever and engaging means operable by the switch lever to selectively connect the first and second input means to the first and second output means. This construction permits the switching between the two operational modes to be readily effected by operating the switch lever.

Other advantages of this invention will be apparent from the following description.

BRIEF DESCRIPTION OF THE DRAWINGS

The drawings illustrate a valve control structure for a working vehicle embodying this invention, in which.

DESCRIPTION OF THE PREFERRED EMBODIMENT

Figure 1:
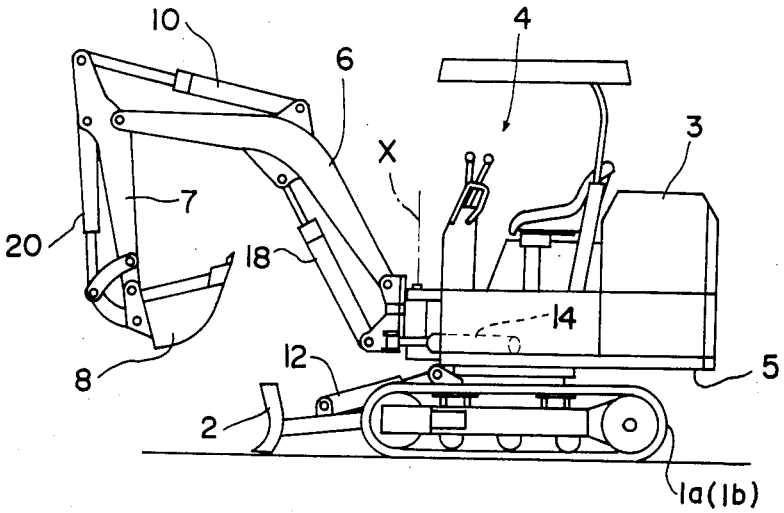
FIG. 1 is a side elevation of a working vehicle.

Referring to FIG. 1, a working vehicle comprises a chassis provided with crawlers 1*a* and 1*b* and a bulldozing blade 2, and a swivel deck 5 mounted on the chassis and carrying a motor section 3 and a driver's section 4. The swivel deck 5 further carries a backhoe implement horizontally swingable on a vertical axis X as well as vertically swingable. The backhoe implement includes a boom 6 and arm 7 connected to each other for flexing movements, the arm 7 carrying an oscillatable bucket 8 at an extreme end thereof.

Figure 2:
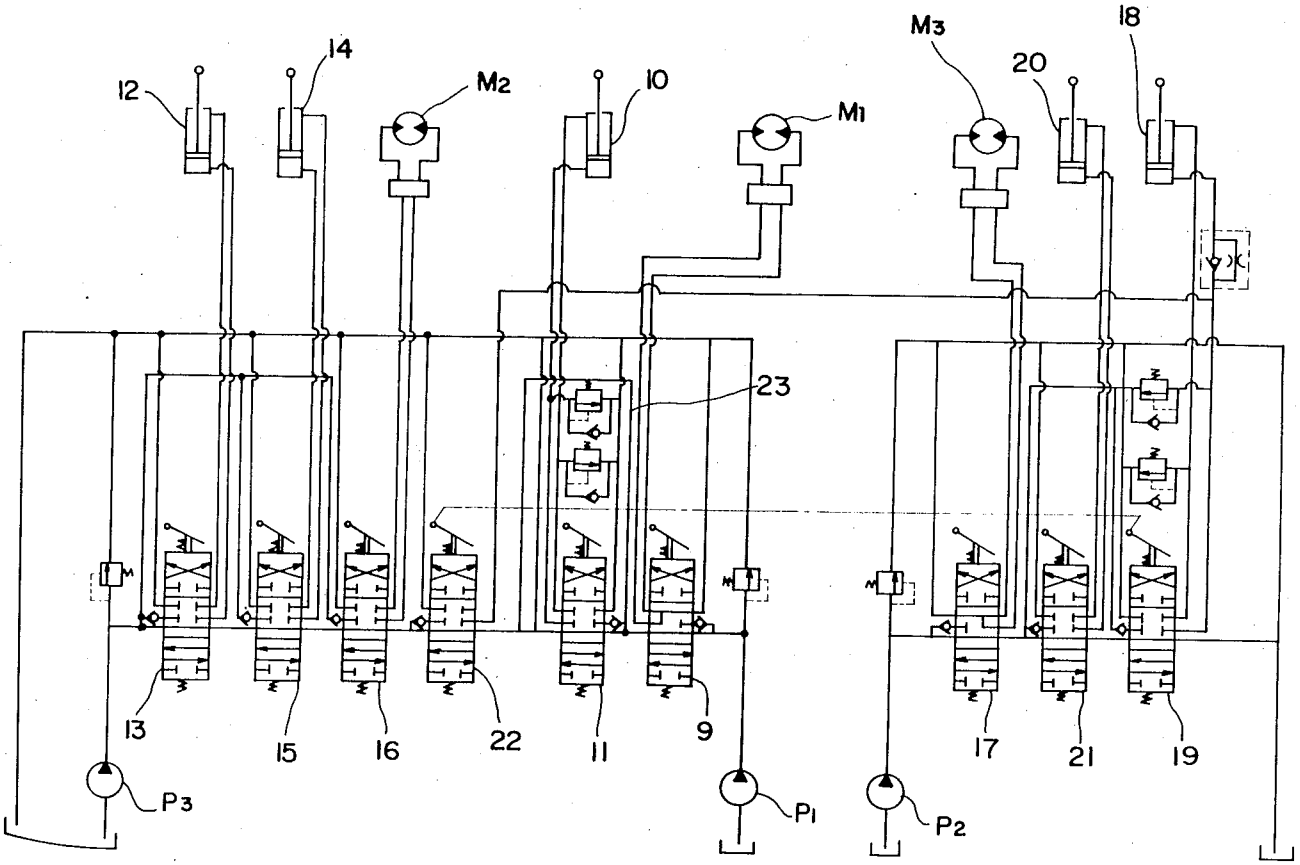
FIG. 2 is a view of a hydraulic circuitry.

The crawlers 1*a* and 1*b*, the bulldozing blade 2, the swivel deck 5 and the backhoe implement are driven by a hydraulic circuitry shown in FIG. 2. As seen, the hydraulic circuitry includes two main pump P1 and P2 and one auxiliary pump P3. A control valve 9 to control a first hydraulic motor M1 for driving the lefthand crawler 1a is connected to the first main pump P1. A control valve 11 to control an arm cylinder 10 for driving the arm 7 is connected to the lefthand crawler control valve 9 such that the control valve 11 receives oil under pressure from the first main pump P1 when the lefthand crawler control valve 9 is in neutral. A control valve 13 to control a bulldozer cylinder 12 for raising and lowering the bulldozer blade 2, a control valve 15 to control a swing cylinder 14 for swinging the backhoe implement on the vertical axis X, and a control valve 16 to control a hydraulic motor M2 for driving the swivel deck 5 are connected to the auxliliary pump P3 in parallel to one another. A control valve 17 to control a hydrauliic motor M3 for driving the righthand crawler 1b is connected to the second main pump P2. A control valve 19 to control a boom cylinder 18 for swinging the boom 6 and a control valve 21 to control a cylinder 20 for oscillating the bucket 8 are connected to the righthand crawler control valve 17 in parallel to each other such that the control valves 19 and 21 receive oil under pressure from the second main pump P2 when the righthand crawler control valve 17 is in neutral. An accelerator valve 22 is connected to an oil line extending from the control valve 19 to the boom cylinder 18 to add the oil from the auxiliary pump P3 to the oil flowing through that oil line thereby to increase a boom rising speed. The accelerator valve 22 is connected to the swivel deck control valve 16 such that the accelerator valve 22 receives the oil from the auxiliary pump P3 when the swivel deck control valve 16 is in neutral. An accelerating oil line 23 is provided to add the oil from the auxiliary pump P3 to the oil supplied from the first main pump P1 to the control valve 11 thereby to cause the arm cylinder 10 to actuate the arm 7 at an increased speed. This accelerating oil line 23 is connected to the boom accelerator valve 22 such that the accelerating oil line 23 receives the oil from the auxiliary pump P3 when the accelerator valve 22 is in neutral.

Figure 3:
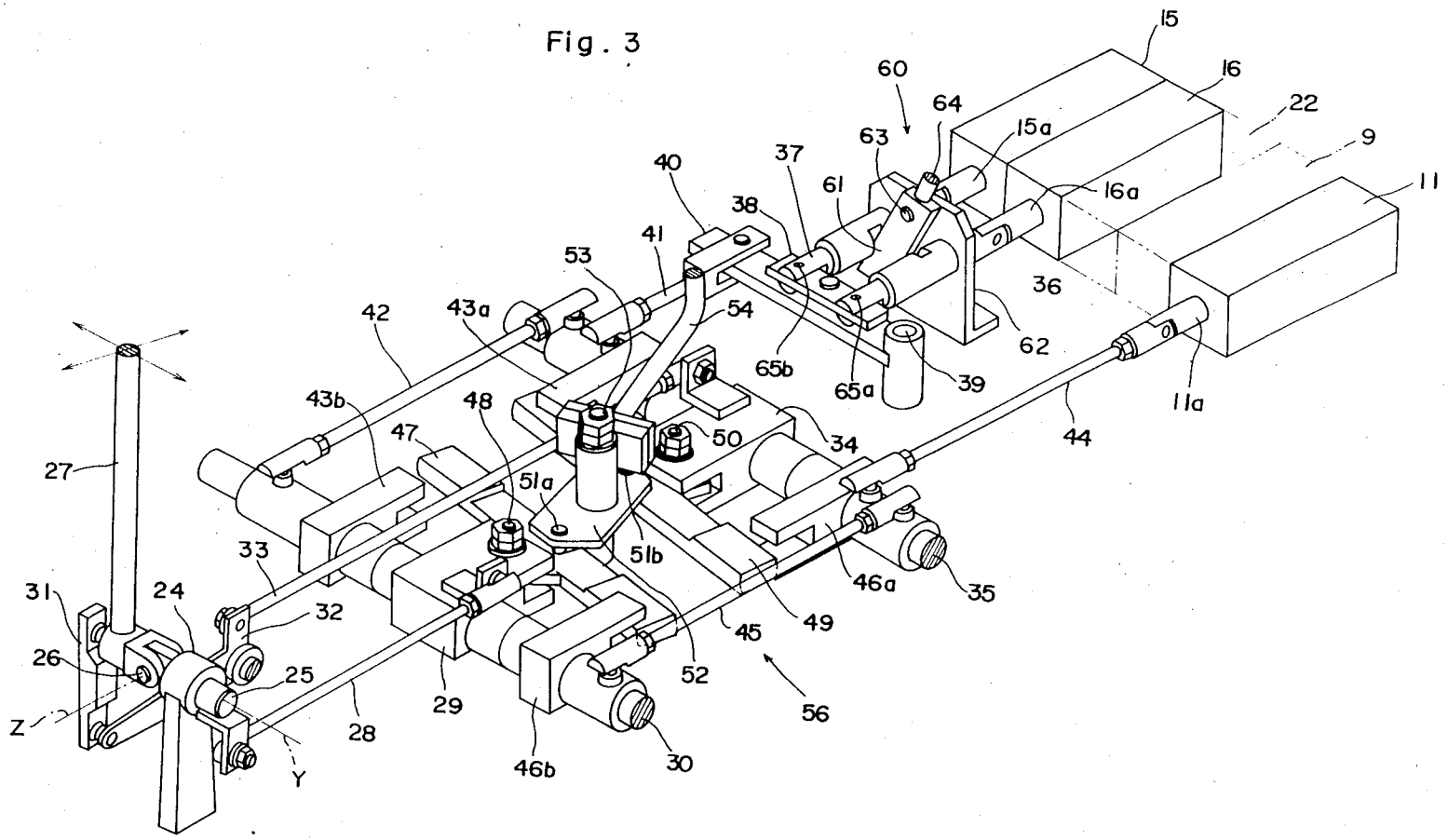
FIG. 3 is a perspective view of the valve control structure.

The swivel deck control valve 16, the swing control valve 15 and the arm control valve 11 are operated by a valve control structure as shown in FIG. 3. This control structure includes a control lever 27 is attached to a stationary boss 24 in the driver's section 4 through a connecting member 25 rotatable on a first axis Y extending in a transverse direction of the swivel deck and a connecting pin 26 having a second axis Z extending in a fore-and-aft direction of the swivel deck. Thus the control lever 27 is rockable crosswise about the first axis Y or in the fore-and-aft direction of the swivel deck and about the second axis Z or in the transverse direction of the swivel deck. A rocking movement in the fore-and-aft direction causes the connecting member 25 to rotate in unison therewith by means of the connecting pin 26. A first input member 29 is operatively connected to the control lever 27 through the connecting pin 26, the connecting member 25 and a push-pull rod 28. The first input member 29 is mounted on a first support shaft 30 on the swivel deck to be rotatable within a predetermined angle by rocking movements of the control lever 27 in the fore-and-aft direction of the swivel deck 5. A second input member 34 is operatively connected to the control lever 27 through a push-pull rod 31, an oscillatable connecting member 32 and a push-pull rod 33. The second input member 34 is mounted on a second support shaft 35 to be rotatable within the predetermined angle by rocking movements of the control lever 27 in the transverse direction of the swivel deck 5.

The swivel deck control valve 16 includes a spool 16*a* to which one end of a push-pull rod 36 is connected, and the swing control valve 15 includes a spool 15*a* to which one end of a push-pull rod 37 is connected. These push-pull rods 36 and 37 are connected at the other ends to an oscillatable connecting element 38, respectively. This connecting element 38 is pivotally connected at an intermediate position to an intermediate position of an arm 40 pivotally connected at one end thereof to a support post 39 fixed to the swivel deck 5. A first output member 43*b* including a bifurcate portion is rotatably mounted on the first support shaft 30 next to the first input member 29, and a second output member 43*a* including a bifurcate portion opposed to the bifurcate portion of the first output member 43*b* is rotatably mounted on the second support shaft 35 next to the second input member 34. The first output member 43*b* and the second output member 43*a* are operatively connected to each other by a push-pull rod 42, and the arm 40 is operatively connected to the second output member 43*a* by a push-pull rod 41.

Furthermore, a third output member 46*b* including a bifurcate portion is rotatably mounted on the first support shaft 35 next to the first input member 29 and opposed to the first output member 43*b* across the first input member 29. A fourth output member 46*a* including a bifurcate portion opposed to the bifurcate portion of the third output member 46*b* is rotatably mounted on the second support shaft 35 next to the second input member 34 and opposed to the second output member 43*a* across the second input member 34. The third output member 46*b* and the fourth output member 46*a* are operatively connected to each other by a push-pull rod 45, and the fourth output member 46*a* is operatively connected to a spool 11*a* of the arm control valve 11 by a push-pull rod 44.

Figure 4:
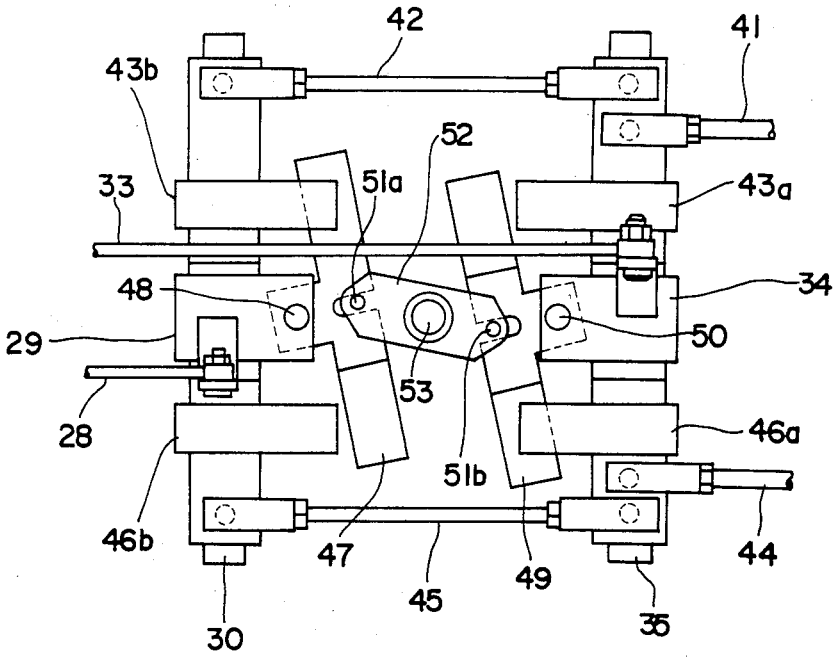
FIGS. 4 and 5 are plan views of a connection switching mechanism, respectively.
Figure 5:
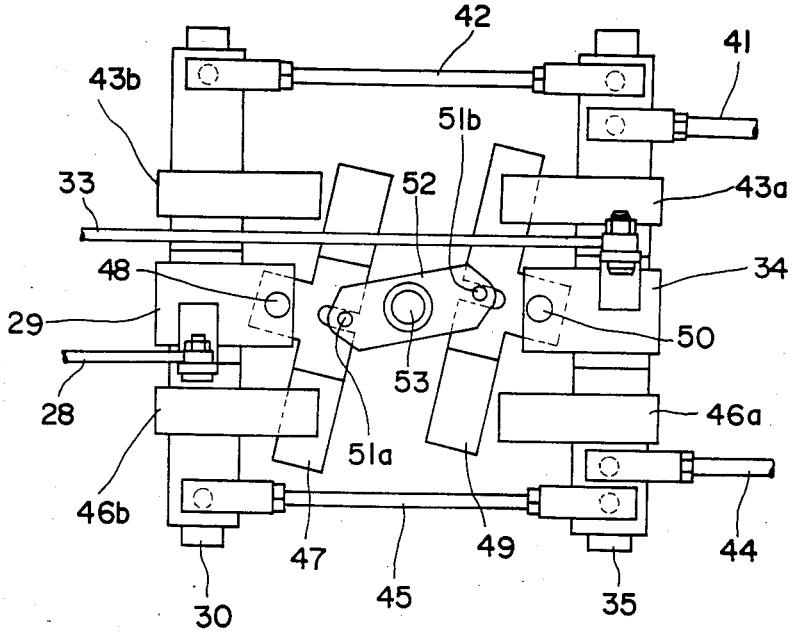

The valve control structure further comprises a connection switching mechanism 56 disposed between the first and second input members and the first to fourth output members. The connection switching mechanism 56 includes a first engaging member 47 and a second engaging member 49. The first engaging member 47 is attached through a connecting rod 48 to the first input member 47 to be rotatable therewith about the first support shaft 30. The first engaging member 47 is switchable by pivoting about the connecting rod 48, between a first position (FIG. 4) in which one end of the first engaging member 47 is in engagement with the bifurcate portion of the first output member 43*b* and the other end thereof is out of engagement with the bifurcate portion of the third output member 46*b* and a second position (FIG. 5) in which the one end of the first engaging member 47 is out of engagement with the bifurcate portion of the first output member 43*b* and the other end thereof is in engagement with the bifurcate portion of the third output member 46*b*. Thus in the first position the first output member 43*b* is operatively connected to the first input member 29 to be rotatable together, and in the second position the third output member 46*b* is operatively connected to the first input member 29 to be rotatable together. The second engaging member 49 is attached through a connecting rod 50 to the second input member 34 to be rotatable therewith about the second support shaft 35. The second engaging member 49 is switchable, by pivoting about the connecting rod 50, between a first position (FIG. 4) in which one end of the second engaging member 49 is in engagement with the bifurcate portion of the fourth output member 46*a* and the other end thereof is out of engagement with the bifurcate portion of the second output member 43*a* and a second position (FIG. 5) in which the one end of the second engaging member 49 is out of engagement with the bifurcate portion of the fourth output member 46*a* and the other end thereof is in engagement with the bifurcate portion of the second output member 43*a*. Thus, in the first position the fourth output member 46*a* is operatively connected to the second input member 34 to be rotatable together, and in the second position the second output member 43*a* is operatively connected to the second input member 34 to be rotatable together.

Figure 6:
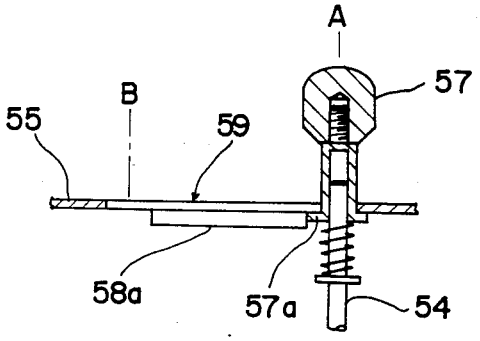
FIG. 6 is a sectional view of a portion for operating the connection switching mechanism.
Figure 7:
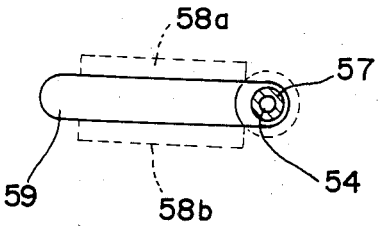
FIG. 7 is a plan view partly in section of the portion for operating the connection switching mechanism.

A link 52 is pivotably mounted on a support post 53 fixed to the swivel deck 53. The link 52 carries pins 51*a* and 51*b* at respective ends thereof, the pins 51*a* and 51*b* being in engagement with cut-out portions of the first and second engaging members 47 and 49, respectively. A switch lever 54 is rigidly connected to the link 52 and extends upwardly therefrom above a floor 55 of the driver's section as shown in FIGS. 6 and 7. As seen in FIG. 6, a grip 57 is slidably attached to the switch lever 54, the grip 57 being provided with an engaging portion 57*a* for preventing the grip 57 from coming off upwardly from the floor 55. By depressing the grip 57 against the biasing force of a spring as shown to bring the engaging portion 57*a* below a pair of steppers 58*a* and 58*b*, the switch lever 54 is shiftable along a lever guide slot 59 between a first position A to place the first and second engaging members 47 and 49 in the first position shown in FIG. 4 and a second position B to place the engaging members 47 and 49 in the second position shown in FIG. 5. By placing the engaging portion 57*a* in engagement with the stoppers 58*a* and 58*b*, the switch lever 54 is locked in the first position A or the second position B thereby to lock the first and second engaging members 47 and 49 in the corresponding position.

When the switch lever 54 is in the first position A, the first input member 29 is operatively connected by the first engaging member 47 to the swivel deck control valve 16 or the swing control valve 15, and the second input member 34 is operatively connected by the second engaging member 49 to the arm control valve 11. In this operational mode the swivel deck control valve 16 or the swing control valve 15 is operated by rocking movement of the control lever 27 in the fore-and-aft direction of the swivel deck, and the arm control valve 11 is operated by rocking movements of the control lever 27 in the transverse direction of the swivel deck. When the switch lever 54 is in the second position B, the first input member 29 is operatively connected by the first engaging member 47 to the arm control valve 11, and the second input member 34 is operatively connected by the second engaging member 49 to the swivel deck control valve 16 or the swing control valve 15. In this operational mode, the arm control valve 11 is operated by the rocking movements of the control lever 27 in the fore-and-aft direction of the swivel deck and the swivel deck control valve 16 or the swing control valve 15 is operated by the rocking movements of the control lever 27 in the transverse direction of the swivel deck.

A switch mechanism 60 is provided between the control valves 15 and 16 and the arm 40 to select one of the control valves 15 to be operable by the control lever 27. As shown in FIG. 3, this switching mechanism 60 comprises a stopper 61 attached to a support member 62 secured to the swivel deck 5. The stopper 61 is pivotable on a connecting pin 63 fixed to the support member 62 to selectively engage with the push-pull rod 36 or the push-pull rod 37. More particularly, this stopper 61 is switchable by a lever 64 between a position to engage a cutout defined in the push-pull rod 37 thereby to operatively connect the swivel deck control valve 16 to the arm 40 and a position to engage a cutout defined in the push-pull rod 36 thereby to operatively connect the swing control valve 15 to the arm 40. It will be understood that the push-pull rod 36 or 37 engaged by the stopper 61 is locked against sliding, and pivoting of the arm 40 caused by the movement of the control lever 27 results in pivoting of the connecting element 38 on a connecting pin 65*a* or 65*b* connecting the locked push-pull rod 36 or 37 to the connecting element 38, whereby either the swivel deck control valve 16 or the swing control valve 15 is operable by the control lever 27.

The boom control valve 19 and the bucket control valve 21 are constructed to be operable by a further control lever rockable crosswise (not shown), and the described operational mode switching mechanism may also be employed for these valves. Further, this invention is applicable to control structure for other types of working vehicle such as a face shovel vehicle, a bulldozer and the like.

It will be apparent to those skilled in the art that the valve control structure of this invention produces the same effect whether the structure is vertical or horizontal.

What is claimed is:

1. A valve control structure for a working vehicle comprising:

a control lever (27) rockable crosswise;

a first input means (29) and a second input means (34) connected to the control lever, the first input means (29) being operable by a rocking movement in a first direction of the control lever, and the second input means (34) being operable by a rocking movement in a second direction of the control lever;

a first output means (43) connected to first valve means (16) and a second output means (46) connected to second valve means (11); and connection switching means interposed between the first and second input means and the first and second output means and including a switch lever (54) and engaging means (47), (49), (52), the engaging means being switchable by shifting the switch lever between a first position wherein the first input means is operatively connected to said first valve means and the second input means is operatively connected to the second valve means and a second position wherein the first input means is operatively connected to second valve means and the second input means is operatively connected to the first valve means.

2. A valve control structure as claimed in claim 1 wherein the engaging means includes a first engaging member (47) attached to the first input means (29), a second engaging member (49) attached to the second input means (34), and a link (52) operatively connected to the first and second engaging members and secured to the switch lever (54).

3. A valve control structure as claimed in claim 2 wherein the link (52) is rotatably mounted on a support post (53), the link carrying a pin (51*a*) in engagement with the first engaging member (47) for oscillating the first engaging member relative to the first input means, and a further pin (51*b*) in engagement with the second engaging member (49) for oscillating the second engaging member relative to the second input means (34).

4. A valve control structure as claimed in claim 3 wherein the first output means includes a first output member (43*b*) disposed adjacent the first input means and a second output member (43*a*) disposed adjacent the second input means, and the second output means includes a third output member (46*b*) disposed adjacent the first input means and a fourth output member (46*a*) disposed adjacent the second input means, the first engaging member (47) being selectively engagable with the first output member and the third output member, and the second engaging member (49) being selectively engageable with the second output member and the fourth output member.

5. A valve control structure as claimed in claim 4 wherein the first input means, the first output member and the third output member are rotatable mounted on a first support shaft (30), respectively, and the second input means, the second output member and the fourth output member are rotatably mounted on the second support shaft (35), respectively.

* * * * *